US009453297B2

(12) United States Patent
Alexander et al.

(10) Patent No.: US 9,453,297 B2
(45) Date of Patent: Sep. 27, 2016

(54) LAUNDRY TREATING APPLIANCE WITH A DYNAMIC BALANCER

(71) Applicant: Whirlpool Corporation, Benton Harbor, MI (US)

(72) Inventors: Benjamin E. Alexander, Stevensville, MI (US); Michael K. Cluskey, West Lafayette, IN (US); John M. Hunnell, Saint Joseph, MI (US); Christopher A. Jones, Uniontown, PA (US); Brenner M. Sharp, Bridgman, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 14/559,450

(22) Filed: Dec. 3, 2014

(65) Prior Publication Data

US 2016/0160421 A1 Jun. 9, 2016

(51) Int. Cl.
*F16F 15/32* (2006.01)
*D06F 37/24* (2006.01)

(52) U.S. Cl.
CPC ..... *D06F 37/245* (2013.01)

(58) Field of Classification Search
CPC ..... F16F 15/16; D06F 37/20; D06F 37/265
USPC ..... 74/572.4
See application file for complete search history.

(56) References Cited

U.S. PATENT DOCUMENTS

| | | | | |
|---|---|---|---|---|
| 4,044,626 | A | 8/1977 | Hayashi et al. | |
| 4,075,909 | A * | 2/1978 | Deakin | F16F 15/363 464/180 |
| 6,082,151 | A | 7/2000 | Wierzba et al. | |
| 6,213,717 | B1 * | 4/2001 | Bucher | F04D 25/088 415/119 |
| 2009/0158783 | A1 * | 6/2009 | Urbiola Soto | D06F 37/245 68/23.2 |
| 2011/0047715 | A1 * | 3/2011 | Kim | D06F 37/203 8/137 |
| 2013/0174690 | A1 | 7/2013 | Yoshinari et al. | |

FOREIGN PATENT DOCUMENTS

JP 58073394 A * 5/1983

* cited by examiner

*Primary Examiner* — Vicky Johnson

(57) ABSTRACT

A dynamic balancer device for mounting to and balancing a rotatable drum in a laundry treating appliance. The dynamic balancer device comprises an enclosed annular housing having a radial circumferential wall, a plurality of internal baffles in the enclosed annular housing and a fluid disposed in the annular race and movable therein.

18 Claims, 4 Drawing Sheets

LAUNDRY TREATING APPLIANCE WITH A DYNAMIC BALANCER

BACKGROUND OF THE INVENTION

A laundry treating appliance such as a washing machine may implement cycles of operation in which a wash basket defining a treating chamber for receiving a laundry load is rotated at high speeds, such as during a spin or water extraction phase. For example, to extract the water from a laundry load, the wash basket is typically spun at high speeds. If a sufficiently large enough load imbalance is present, the laundry treating appliance may experience undesirable vibrations and movements when the wash basket is rotated at high speeds during the spin phase.

BRIEF DESCRIPTION

The invention relates to a dynamic balancer device for mounting to and balancing a rotatable drum in a laundry treating appliance. The dynamic balancer device comprises an enclosed annular housing having radial circumferential walls defining an enclosed annular race, a plurality of floatable internal baffles and a plurality of locking tabs in the enclosed annular housing, each locking tab corresponding to each internal baffle and a fluid disposed in the annular race and movable therein.

DETAILED DESCRIPTION

Figure 1:
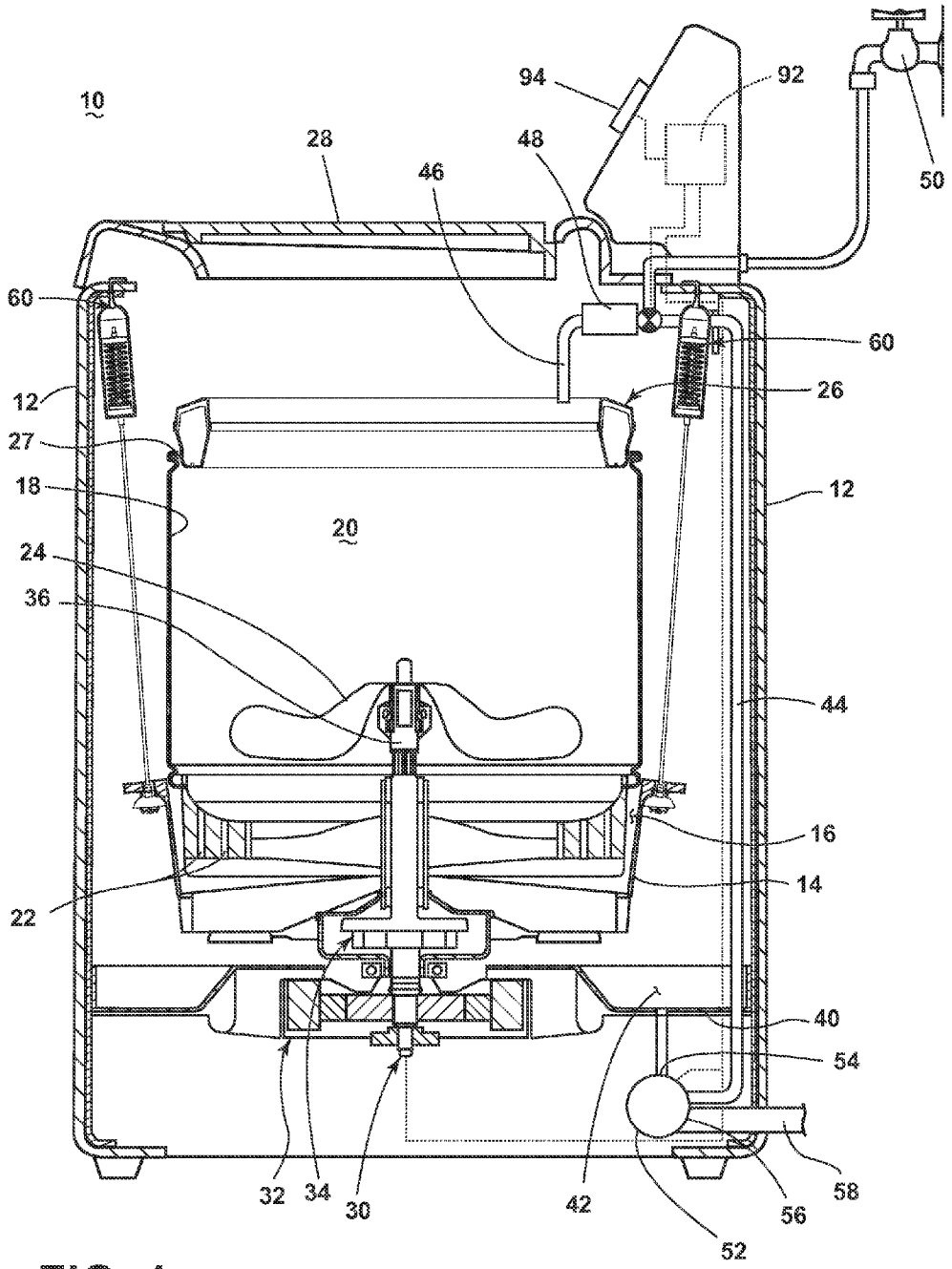
FIG. 1 is a schematic cross-sectional view of a laundry treating appliance according to a first embodiment of the invention.

FIG. 1 illustrates an exemplary laundry treating appliance 10 in the form of a washing machine according to a first embodiment of the invention. While the laundry treating appliance 10 has been illustrated as a vertical axis, top-fill washing machine, embodiments of the invention may have applicability in other laundry treating appliances including by way of non-limiting example a combination laundry washing and drying machine, a non-aqueous laundry treating appliance, etc. The washing machine 10 may include a housing or cabinet 12 and a static wash tub 14, which may be in a fixed position with respect to the cabinet 12. It will be understood that the cabinet 12 may be a frame or chassis with or without panels attached. By "static wash tub," it is not necessarily meant that the wash tub 14 is fixedly integrated to the cabinet 12. For example as illustrated in FIG. 1, the wash tub 14 may be referred to as the static wash tub as long as the wash tub 14 may be in a fixed position with respect to the cabinet 12. For example, the static wash tub 14 may be spaced from the cabinet 12 by a predetermined distance. The static wash tub 14 may define an interior 16 within which a rotatable drum or wash basket 18 may be mounted for rotation about a vertical axis.

The wash basket 18 may define a laundry treating chamber 20 for receiving a laundry load. The wash basket 18 may include one or more drain holes 22 formed on the base portion of the wash basket 18 to discharge the liquid from the wash basket 18 through the one or more drain holes 22. A clothes mover or agitator 24 may be located within the laundry treating chamber 20 and rotatable relative to and/or with the wash basket 18. For example, the agitator 24 may be oscillated or rotated about its axis of rotation during a cycle of operation in order to provide movement to the fabric load contained within the laundry treating chamber 20.

The top of the cabinet 12 may include a selectively openable lid 28 to provide access into the laundry treating chamber 20 through the open top of the wash basket 18.

An electric motor assembly 30 may be provided to drive the wash basket 18 and/or the agitator 24. The electric motor assembly 30 may include, among other things, a motor 32, a transmission 34, and a shaft 36. The electric motor assembly 30 may be operably connected to the wash basket 18 and/or the agitator 24. For example, the shaft 36 may be rotatably coupled to the agitator 24. Alternative motor assemblies with differing configurations than illustrated in the drawings may be used. For example, a direct drive motor with an exterior rotor and an interior stator may be used with or without a transmission, based upon clearance requirements beneath the motor assembly.

A catch basin 40 may be fixedly positioned in the lower portion of the cabinet 12 and may have walls for accommodating a predetermined amount of wash liquid draining from the wash basket 18. While the catch basin 40 may be located within the interior of the cabinet 12, it may be understood that positioning the catch basin 40 exterior of the cabinet 12 may also be possible in another embodiment. The catch basin 40 may form a sump 42 and may be provided with a liquid level sensor for determining the liquid height in the catch basin 40. The catch basin 40 may also be provided with a turbidity sensor for determining the turbidity of the wash liquid received in the catch basin 40.

A spraying system may be provided to supply the liquid, such as water or a combination of water and one or more treating chemistries into the open top of the wash basket 18. The spraying system may be configured to recirculate wash liquid from the catch basin 40, and spray it onto the laundry via a recirculation conduit 44 and a sprayer 46. The nature of the spraying system is not germane to embodiments of the invention, and thus any suitable spraying system may be used with the washing machine 10.

A dispensing system may be provided to the washing machine 10 for supplying treating chemistry to the treating chamber 20 according to a cycle of operation. The dispensing system may include a detergent dispenser 48, which may be a single use dispenser, a bulk dispenser or a combination of a single use and bulk dispenser. As illustrated in FIG. 1, the detergent dispenser 48 may be positioned within the static wash tub 14, and may be disposed vertically above the catch basin 40 for providing one or more treating chemistries to the catch basin 40 by gravity according to a cycle of operation. The detergent dispenser 48 may include a conduit with a predetermined dimension for guiding the supply of one or more treating chemistries to the catch basin 40. The treating chemistries may be in the form of at least one of liquid, powder, pod, compressed puck, or combination thereof.

The treating chemistries may be provided without being mixed with wash liquid from the recirculation conduit 44 or water from the household water supply 50. In another embodiment, the detergent dispenser 48 may be operably configured to dispense a treating chemistry mixed with water supplied from the household water supply 50 through the sprayer 46. The sprayer 46 may be configured to dispense the treating chemistry into the treating chamber 20 in a desired pattern and under a desired amount of pressure. For example, the sprayer 46 may be configured to dispense a flow or stream of treating chemistry into the wash tub 14 by gravity, i.e. a non-pressurized stream. Non-limiting examples of treating chemistries that may be dispensed by the dispensing system during a cycle of operation include one or more of the following: water, surfactants, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

A recirculation and drain system may be provided to the laundry treating appliance 10 for recirculating liquid within and/or draining liquid from the laundry treating appliance 10. A pump 52 may have an inlet 54 fluidly coupled to the sump 42 and an outlet 56 configured to fluidly couple to the recirculation conduit 44 and a drain conduit 58. It may be understood that the pump 52 may be configured to switch the pumping direction by operating the motor coupled to the pump 52 in the reverse direction. Alternatively, two separate pumps, such as a recirculation pump and a drain pump, may be used instead of the single pump.

Additionally, the spraying system, the dispensing system, and the recirculation and drain system may differ from the configuration shown in FIG. 1, such as by inclusion of other valves, conduits, treating chemistry dispensers, sensors and the like, to control the flow of liquid through the washing machine 10 and for the introduction of more than one type of treating chemistries.

A plurality of suspension assemblies 60 may be provided in the laundry treating appliance 10 for damping the vibrations generated during the rotational movement of the wash basket 18. The suspension assembly 60 may be operably coupled to an upper portion of the cabinet 12 and a portion of the wash tub 14 such that the wash tub 14 may be suspended from the cabinet 12.

Figure 2:
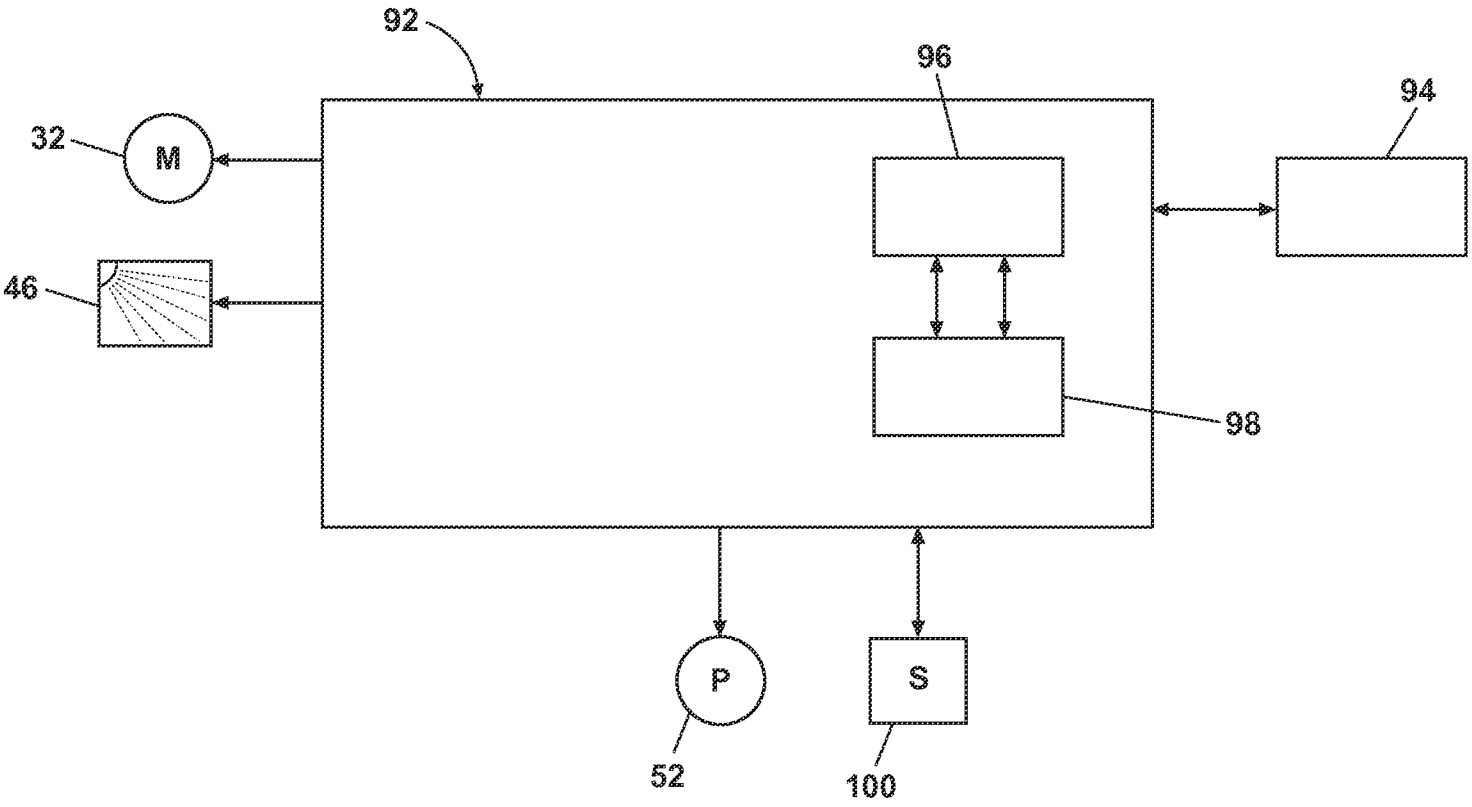
FIG. 2 is a schematic view of a controller of the laundry treating appliance of FIG. 1.

The washing machine 10 also includes a control system for controlling the operation of the washing machine 10 to implement one or more cycles of operation. The control system may include a controller 92 and a user interface 94 that may be operably coupled with the controller 92. The user interface 94 may include one or more knobs, dials, switches, displays, touch screens, and the like for communicating with the user, such as to receive input and provide output. The user may enter different types of information including, without limitation, cycle selection and cycle parameters, such as cycle options. The controller 92 may include the machine controller and any additional controllers provided for controlling any of the components of the washing machine 10. For example, the controller 92 may include the machine controller and a motor controller. Many known types of controllers may be used for the controller 92. The specific type of controller is not germane to embodiments of the invention. It may be contemplated that the controller 92 may be a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), may be used to control the various components. As illustrated in FIG. 2, the controller 92 may be provided with a memory 96 and a central processing unit (CPU) 98. The memory 96 may be used for storing the control software that may be executed by the CPU 98 in implementing a cycle of operation using the washing machine 10 and any additional software. Examples, without limitation, of cycles of operation include: wash, heavy duty wash, delicate wash, quick wash, pre-wash, refresh, rinse only, and timed wash. A common wash cycle includes a wash phase, a rinse phase, and a spin extraction phase. Other phases for cycles of operation include, but are not limited to, intermediate extraction phases, such as between the wash and rinse phases, and a pre-wash phase preceding the wash phase, and some cycles of operation include only a select one or more of these exemplary phases. The memory 96 may also be used to store information, such as a database or table, and to store data received from one or more components of the washing machine 10 that may be communicably coupled with the controller 92. The database or table may be used to store the various operating parameters for the one or more cycles of operation, including factory default values for the operating parameters and any adjustments to them by the control system or by user input.

The controller 92 may be operably coupled with one or more components of the washing machine 10 for communicating with and controlling the operation of the component to complete a cycle of operation. For example, the controller 92 may be operably coupled with the motor 30, the pump 52, and the detergent dispenser 48 to control the operation of these and other components to implement one or more of the cycles of operation. The controller 92 may also be coupled with one or more sensors 100 provided in one or more of the systems of the washing machine 10 to receive input from the sensors, which are known in the art and not shown for simplicity. Non-limiting examples of sensors 100 that may be communicably coupled with the controller 92 include: a treating chamber temperature sensor, a moisture sensor, a weight sensor, a chemical sensor, a position sensor, a motor torque sensor, the liquid level sensor, and the turbidity sensor, which may be used to determine a variety of system and liquid characteristics. For example, when the turbidity of one of the wash liquid or rinse liquid in the wash basket 18 or the catch basin 40 satisfies a predetermined threshold, the wash liquid or rinse liquid may be drained by the activation of the pump 52, and fresh water may be supplied to the wash basket 18 from the household water supply 50.

When the wash phase in the wash cycle begins, water may be provided from the household water supply 50. The water may percolate through the laundry items in the wash basket 18, and drain downwardly by gravity through the drain holes 22. The agitator 24 may rotate in at least one of the clockwise or counter clockwise directions for engaging the laundry with the agitator 24 at a predetermined speed according to a cycle of operation. The drain holes 22 may be configured to open, therefore the water may drain through the drain holes 22 when the wash basket 18 may be either in a stationary mode or rotates according to a cycle of operation. Once passing through the drain holes 22, the water may be received in the catch basin 40. The height of wash liquid in the catch basin 40 may be determined by the amount of water initially provided from the household water supply 50 to the treating chamber 20 of the wash basket 18. Therefore, water may be supplied to the wash basket 18 until the water height in the catch basin 40 satisfies a predetermined threshold. For example, an output from the water level sensor may be monitored to determine when the water supply to the wash basket 18 needs to be stopped. The water received in the catch basin 40 may be provided with one or more treating chemistries supplied from the detergent dispenser 48 to the interior of the catch basin 40, and the water and one or more treating chemistries may be physically and/or chemically mixed to each other to form wash liquid. The wash liquid may subsequently be supplied to the inlet 54 of the pump 52 for recirculation through the recirculation conduit 44 back to the laundry items in the wash basket 18. The wash liquid, now a mixture of water and one or more treating chemistries may be percolated through the laundry items in the wash basket 18 while the agitator 24 rotates according to a cycle of operation.

It may be noted that, during the wash phase, the wash liquid may be continuously recirculated from the wash basket 18, through drain holes 22 of the wash basket 18, pump 52, recirculation conduit 44, and then back to the wash basket 18. It may also be noted that treating laundry based on the continuous or semi-continuous percolation of wash liquid may be effective in improving the treating performance of laundry items, compared to a traditional treating step comprising discrete steps of water supply, agitation, and rinsing. The wash phase may be followed by the rinse phase. During the rinse phase, water may be provided to the laundry items in the wash basket 18 through the sprayer 46. Similar to the wash phase, the water supplied from the household water supply 50 may be percolated through the laundry items while the laundry items are agitated by the agitator 24 according to a cycle of operation. During the rinse phase, the water may continuously drain out of the wash basket 18 through one or more drain holes 22, and then recirculate back to the wash basket via the recirculation conduit 44 by the pump 52. One or more treating chemistries for a rinse phase may be provided to the catch basin 40 prior to the onset of or during the rinse phase.

It will be understood that, during the high speed spin extraction phase, the wash basket 18 may be subject to a translational and/or vertical movement from any unbalance of non-uniformly distributed laundry items in the wash basket 18.

The laundry treating appliance 10 may also include a dynamic balancer device 26 at the top side of the rotatable wash basket 18 to offset an imbalance that may occur in the treating chamber 20 during rotation of the rotatable wash basket 18 during a cycle of operation. The dynamic balancer device 26 is adapted to be mounted coaxially with a vertical axis of the treating chamber 18. As shown, the dynamic balancer device 26 may be coupled with the wash basket 18 by a tongue and groove connection 27. Alternatively, the dynamic balancer device 26 may be coupled with the wash basket 18 with screws or the like placed through the wash basket 18 and received by the dynamic balancer device 26 or the dynamic balancer device 26 may be integrally formed with the wash basket 18.

Figure 3:
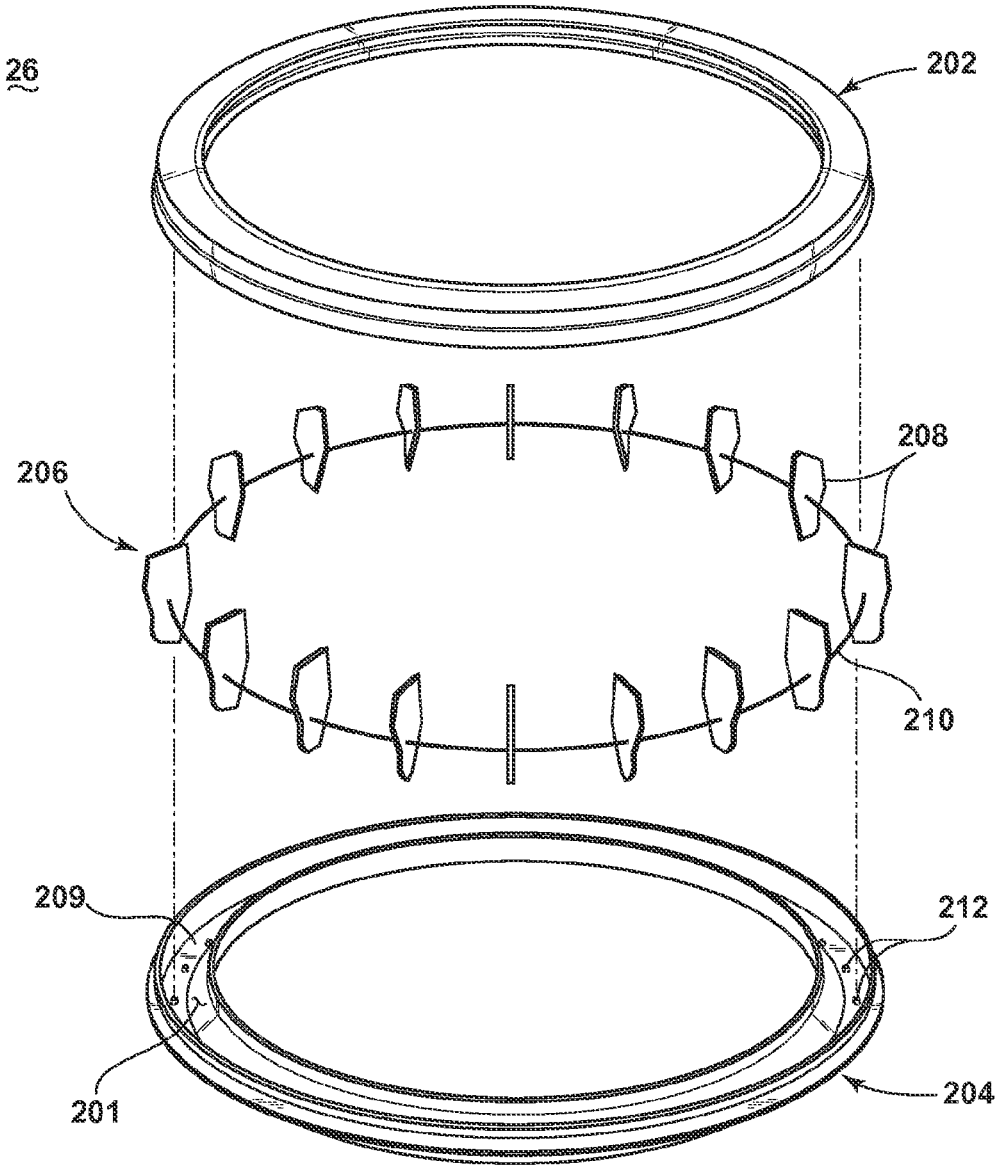
FIG. 3 an exploded view of a balance ring according to an embodiment of the invention.

FIG. 3 illustrates an exploded view of the dynamic balancer device 26 according to an embodiment of the invention. The dynamic balancer device 26 includes annular housing having radial circumferential walls formed by an upper housing half 202 and a lower housing half 204 connected together to define an annular race 201, an annular baffle assembly 206 located within the enclosed annular race 201 and a fluid (not shown) also disposed within the annular race 201 and movable therein. The annular baffle assembly 206 includes a plurality of spaced apart interconnected baffles 208. The baffles 208 are orientated transversely to the annular race 201 to selectively restrict the flow of fluid within the annular race 201 and are interconnected by at least one rail 210 extending congruently along the annular race 201 between the baffles 208 in order to provide rigidity to the baffle assembly 206 and to maintain the orientation of the baffles 208.

The lower housing half 204 also includes a plurality of locking tabs 212 protruding upwardly from a bottom housing wall 209 thereof. The locking tabs 212 are spaced apart along the bottom housing wall 209 so as to correspond with the spacing of the baffles 208. The locking tabs 212 may be integrally formed with the lower housing half 204 or affixed thereto. The upper housing half 202, lower housing half 204 and locking tabs 212 may be made from a variety of materials including but not limited to thermoset plastics, thermoplastic, composites or metals and may be manufactured using methods known in the art including but not limited to injection molding, additive manufacturing, casting or stamping.

Figure 4C:
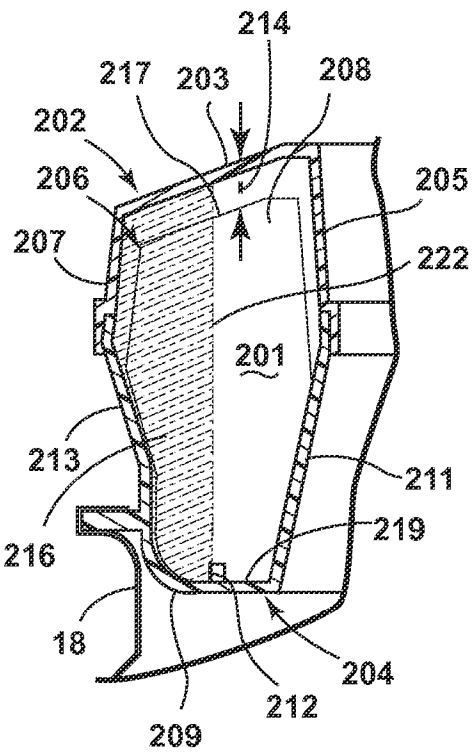
FIG. 4C is a schematic cross-sectional view of the dynamic balancer of FIG. 3 with the dynamic balancer in a coupled position according to one embodiment of the invention.
Figure 4B:
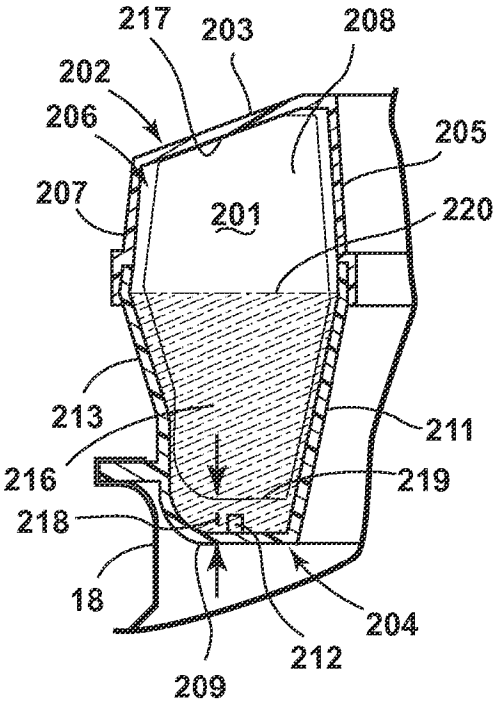
FIG. 4B is a cross-sectional view of the dynamic balancer of FIG. 3 with the dynamic balancer in a floating position according to one embodiment of the invention.
Figure 4A:
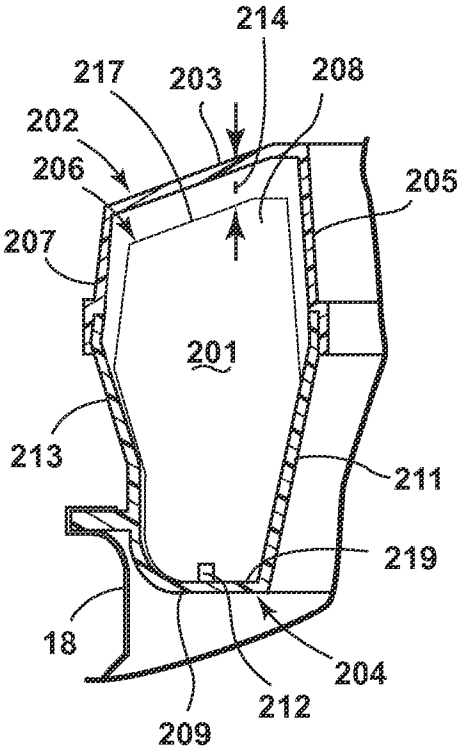
FIG. 4A is a cross-sectional view of the dynamic balancer of FIG. 3 according to one embodiment of the invention.

Turning now to FIG. 4A, there is shown a sectional view of the dynamic balancer device 26 without the fluid disposed in the annular race 201 according to an embodiment of the invention. The baffle assembly 206 is configured to move between a coupled position and a floating position within the annular race 201. In the coupled position, bottom baffle walls 219 of the baffles 208 rest on the bottom housing wall 209, forming a top gap 214 between the top baffle walls 217 and a top housing wall 203. The locking tabs 212 extending above the bottom baffle walls 219, engage the lower portion of the baffles 208 so as to prevent the baffle assembly 206 from rotating within the annular race 201 relative to the annular housing.

When a fluid 216 is disposed within the annular race 201 when the dynamic balancer device 26 is not rotating at a high speed, the baffle assembly 206 is configured to move to the floating position as shown in FIG. 4B. In the floating position, the fluid 216 is disposed in the annular race 201 such that a substantially horizontal free surface 220 is formed on the surface of the fluid 206 not in contact with the annular housing. The fluid 216 imparts a buoyancy force on the baffle assembly 206, causing the baffle assembly 206 to move upwards towards the top housing wall 203, forming a bottom gap 218 between the bottom baffle walls 219 and the bottom housing wall 209. In this configuration, the baffle assembly 206 is free to move with the fluid 216 within the annular race 201.

In one embodiment, the buoyancy force may be achieved by forming the baffle assembly 206 from a material having a lower density than the fluid 216. Examples of suitable materials may include thermoset plastics, thermoplastics or composite materials. In a preferred embodiment, the baffle assembly may be formed from polypropylene using injection molding and the fluid 216 may be water.

In another embodiment, the baffle assembly 206 may include air pockets formed within the baffle assembly 206 such that weight of the baffle assembly 206 is less than the weight of the fluid 216 displaced by the baffle assembly 206 when fully submerged. The air pockets may be formed in the baffles 208 or the rail (shown in FIG. 3).

The annular race 201 and baffles 208 are dimensioned such that when baffle assembly 206 is in the floating position, the bottom gap 218 is larger than the height of the locking tabs 212, defined by the distance the locking tabs 212 extend from the bottom housing wall 209 into the annular race 201, so that the baffles 208 disengage from the locking tabs 212. Once disengaged from the locking tabs 212, the baffle assembly 206 may rotate independently of the annular housing.

The buoyance force on the baffle assembly 206 may be optimized such that in the floating position, that bottom gap 218 is sufficient to allow the bottom baffle walls 219 to clear the locking tabs 212 and such that frictional forces between the top baffle walls 217 and the top housing wall 203 are minimized or non-existent. The buoyance force may be optimized by adjusting the density or amount of the fluid 216 within the annular race 201, adjusting the geometry of the annular race 201 and/or by adjusting the density or geometry of the baffle assembly 206.

During rotation of the wash basket 18, centrifugal force begins acting on the fluid 216 disposed within the annular race 201. At a critical speed of rotation, the centrifugal force acting on the fluid 216 causes the fluid 216 to satellize against the annular housing outer housing walls 207, 213 of the upper housing half 202 and lower housing half 204, as seen in FIG. 4C. Once at or above the critical speed of rotation, a substantially vertical free surface 222 is formed on the surface of the fluid 216 not in contact with the annular housing, decreasing the buoyance force generated by the fluid 216 on the baffle assembly 206, and causing the baffle assembly 206 to move to the coupled position, coupling the baffles 208 with the locking tabs 212. When in the coupled position, the locking tabs 212 couple the baffle assembly 206 to annual housing, causing the baffle assembly 206 and annular housing to rotate in unison.

The buoyance force on the baffle assembly 206 may be optimized such that the baffle assembly 206 moves from the floating position to the coupled position at or near the predetermined critical speed of rotation. It will be understood that during rotation, the free surface of the fluid 216 moves from the horizontal free surface 220 shown in FIG. 4B, to the vertical free surface 222 shown in FIG. 4C, resulting in a non-vertical or non-horizontal free surface of the fluid 216 and that the varying angles of the fluid free surface are taken into account to optimize the buoyancy force of the fluid 216 in the coupled position and floating position. For example, the buoyance force may be optimized such that the baffle assembly 206 remains in the floating position while the free surface of the fluid 216 is moving between the substantially horizontal orientation and the substantially vertical orientation and moves to the coupled position when the free surface of the fluid 216 is in the substantially vertical orientation. The buoyance force may be optimized by adjusting the density or amount of the fluid 216 within the annular race 201, adjusting the geometry of the annular race 201 and/or by adjusting the density or geometry of the baffle assembly 206.

In operation, the wash basket 18 is initially accelerated through a range of speeds below the critical speed, during which the baffle assembly 206 is in the floating position and may rotate independently of the annular housing as shown in FIG. 4B. This prevents the baffles 208 from restricting the rotation of the fluid 216, allowing the fluid 216 to slip within the annular race 201 relative to the annular housing. This prevents sloshing of the fluid 216, alignment of the mass of fluid 216 with an unbalances in the wash load and any dynamic forces that could reduce suspension performance as the wash basket is accelerated. As the wash basket 18 is accelerated through the critical speed and through a second range of speeds greater than the first range of speeds, the baffle assembly 206 moves to the coupled position, coupling the baffle assembly 206 to the annular housing through the locking tabs 212. This allows the baffles 208 to effectively couple the fluid 216 to the annular housing, preventing the fluid 216 from slipping and mitigating the effects of unbalances in the wash load during steady state high speed rotation of the wash basket 18.

To the extent not already described, the different features and structures of the various embodiments may be used in combination with each other as desired. That one feature may not be illustrated in all of the embodiments is not meant to be construed that it may not be, but is done for brevity of description. Thus, the various features of the different embodiments may be mixed and matched as desired to form new embodiments, whether or not the new embodiments are expressly described. All combinations or permutations of features described herein are covered by this disclosure.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention, which is defined in the appended claims.

What is claimed is:

1. A dynamic balancer device for mounting to and balancing a rotatable wash basket in a laundry treating appliance comprising:

an enclosed annular housing having radial circumferential walls defining an enclosed annular race;

a plurality of floatable internal baffles in the enclosed annular race;

a plurality of locking tabs protruding into the enclosed annular race from a wall of the enclosed annular housing, each locking tab corresponding to each internal baffle; and a fluid disposed in the annular race and movable therein.

2. The dynamic balancer device of claim 1 wherein the baffles are interconnected by at least one annular rail extending between the baffles.

3. The dynamic balancer device of claim 1 wherein the locking tabs are affixed to a bottom housing wall of the annular housing.

4. The dynamic balancer device of claim 1 wherein baffles are movable between a coupled position and a floating position.

5. The dynamic balancer device of claim 4 wherein a gap is disposed between the baffles and the radial circumferential walls.

6. The dynamic balancer device of claim 5 wherein the gap is formed between a top baffle wall and a top housing wall in the coupled position.

7. The dynamic balancer device of claim 6 wherein the gap is formed between a bottom baffle wall and a bottom housing wall in the floating position.

8. The dynamic balancer device of claim 7 wherein the gap is larger than the height of the locking tabs.

9. The dynamic balancer device of claim 4 wherein the baffles are interconnected by at least one annular rail extending between the baffles so they rotate together within the annular race relative to the enclosed annular housing when the baffles are in the floating position.

10. The dynamic balancer device of claim 4 wherein the locking tabs are configured to prevent the baffles from rotating within the annular race relative to the enclosed annular housing when the baffles are in the coupled position.

11. The dynamic balancer device of claim 10 wherein the baffles are configured to move to the floating position at a first range of rotational speeds of the wash basket.

12. The dynamic balancer device of claim 11 wherein the baffles are configured to move to the coupled position at a second range of rotational speeds of the wash basket.

13. The dynamic balancer device of claim 12 wherein the second range of rotational speeds is greater than the first range of rotational speeds.

14. The dynamic balancer device of claim 4 wherein the fluid has a free surface not in contact with the annular housing.

15. The dynamic balancer device of claim 14 wherein buoyancy of the baffles is configured by at least one of density or amount of the fluid, geometry of the annular race, or density or geometry of the baffles.

16. The dynamic balancer device of claim 15 wherein the buoyancy of the baffles is configured so that at increasing rotational speed of the wash basket where the free surface moves between a substantially horizontal orientation and a substantially vertical orientation, the baffles remain in the floating position.

17. The dynamic balancer device of claim 15 wherein the buoyancy of the baffles is configured so that the baffles are in the coupled position when the free surface is in a substantially vertical orientation.

18. The dynamic balancer device of claim 1 wherein the baffles are formed from a material having a density less than a density of the fluid.

* * * * *